US012484613B2

(12) United States Patent
Antonopoulos et al.

(10) Patent No.: US 12,484,613 B2
(45) Date of Patent: Dec. 2, 2025

(54) SHISHA DEVICE WITH TROUGH

(71) Applicant: PHILIP MORRIS PRODUCTS S.A., Neuchatel (CH)

(72) Inventors: Roland Antonopoulos, Neuchatel (CH); Ricardo Cali, Mannheim (DE); Giovanna Landi, Mur (CH); Morten Grosfjeld, Sellebakk (NO); Alexandra Linden, Linkoping (SE); Peter Norrby, Mjolby (SE)

(73) Assignee: Philip Morris Products S.A., Neuchatel (CH)

( * ) Notice: Subject to any disclaimer, the term of this patent is extended or adjusted under 35 U.S.C. 154(b) by 429 days.

(21) Appl. No.: 17/777,753

(22) PCT Filed: Dec. 1, 2020

(86) PCT No.: PCT/EP2020/084138

§ 371 (c)(1),
(2) Date: May 18, 2022

(87) PCT Pub. No.: WO2021/110684

PCT Pub. Date: Jun. 10, 2021

(65) Prior Publication Data

US 2023/0200437 A1 Jun. 29, 2023

(30) Foreign Application Priority Data

Dec. 2, 2019 (EP) ..... 19213023

(51) Int. Cl.

| | |
|---|---|
| ***A24F 1/30*** | (2006.01) |
| ***A24F 40/42*** | (2020.01) |
| ***A24F 40/48*** | (2020.01) |

(52) U.S. Cl.

CPC ..... *A24F 1/30* (2013.01); *A24F 40/42* (2020.01); *A24F 40/48* (2020.01)

(58) Field of Classification Search

CPC ..... A24F 1/30; A24F 40/48; A24F 40/42

See application file for complete search history.

(56) References Cited

U.S. PATENT DOCUMENTS

| | | | | |
|---|---|---|---|---|
| 1,513,147 | A * | 10/1924 | Zahariadis | A24F 1/30 131/201 |
| 10,206,430 | B2 | 2/2019 | Mironov | |
| 2008/0060663 | A1 | 3/2008 | Hamade | |
| 2011/0186060 | A1 | 8/2011 | Saleh | |
| 2012/0111345 | A1 | 5/2012 | Sweitzer | |

(Continued)

FOREIGN PATENT DOCUMENTS

| | | | |
|---|---|---|---|
| CN | 104522890 | 4/2015 | |
| DE | 202014005266 U1 * | 8/2014 | A24F 1/30 |

(Continued)

OTHER PUBLICATIONS

EPO Machine Translation of DE 202014005266 U1 (published Aug. 14, 2014). (Year: 2024).*

(Continued)

*Primary Examiner* — Dionne W. Mayes

(74) *Attorney, Agent, or Firm* — Mueting Raasch Group

(57) ABSTRACT

The invention relates to a shisha device comprising: a cavity configured for receiving a capsule comprising aerosol-forming substrate; and a trough in fluid communication with the cavity.

19 Claims, 8 Drawing Sheets

(56) References Cited

U.S. PATENT DOCUMENTS

| | | | | |
|---|---|---|---|---|
| 2015/0053221 | A1* | 2/2015 | Asghar-Sheikh | A24F 40/40 131/329 |
| 2017/0055570 | A1 | 3/2017 | Elhalwani | |
| 2017/0071251 | A1 | 3/2017 | Goch | |
| 2018/0317544 | A1 | 11/2018 | Hagen | |
| 2019/0261679 | A1 | 8/2019 | Aishamma | |
| 2021/0360964 | A1 | 11/2021 | Bozhurt | |

FOREIGN PATENT DOCUMENTS

| | | | | |
|---|---|---|---|---|
| EP | 1941806 | A1 * | 7/2008 | A24F 1/30 |
| EP | 2719294 | | 4/2014 | |
| JP | 2015-526097 | | 9/2015 | |
| JP | 2017511703 | | 4/2017 | |
| RU | 184067 | | 10/2018 | |
| WO | WO 2014/032716 | | 3/2014 | |
| WO | WO 2015/097424 | | 7/2015 | |
| WO | WO 2019/003116 | | 1/2019 | |
| WO | WO 2019/215348 | | 11/2019 | |
| WO | WO 2019/224112 | | 11/2019 | |

OTHER PUBLICATIONS

Office Action issued in Japan for Application No. 2022-525405 dated Mar. 20, 2023 (15 pages). English translation included.

Office Action issued in Ukraine for Application No. a2022 01871 dated Nov. 20, 2023 (8 pages). English translation included.

Office Action issued in Russian for Application No. 2022117508 dated Sep. 22, 2022 (4 pages). English translation included.

PCT Search Report and Written Opinion for Application No. PCT/EP2020/084138 dated Dec. 21, 2020 (11 pages).

International Preliminary Report on Patentability for PCT/EP2020/084138 dated Mar. 16, 2022 (15 pages).

* cited by examiner

SHISHA DEVICE WITH TROUGH

This application is a U.S. National Stage Application of International Application No. PCT/EP2020/084138 filed Dec. 1, 2020, which was published in English on Jun. 10, 2021, as International Publication No. WO 2021/110684 A1. International Application No. PCT/EP2020/084138 claims priority to European Application No. 19213023.5 filed Dec. 2, 2019.

The present invention relates to an aerosol-generating device, such as a shisha device.

Traditional shisha devices are used to smoke tobacco and are configured such that vapor and smoke pass through a water basin before inhalation by a consumer. Shisha devices may include one outlet, or more than one outlet so that the device may be used by more than one consumer at a time. Use of shisha devices is considered by some to be a leisure activity and a social experience.

Typically, traditional shishas are used in combination with a substrate, sometimes referred to in the art as hookah tobacco, tobacco molasses, or simply as molasses. Traditional shisha substrates are relatively high in sugar (in some cases, up to ~50 % vs. the ~20 % typically found in conventional tobacco substrates, such as in combustible cigarettes). The tobacco used in shisha devices may be mixed with other ingredients to, for example, increase the volume of the vapor and smoke produced, to alter flavour, or both.

Traditional shisha devices employ charcoal, such as charcoal pellets to heat and sometimes combust the tobacco substrate to generate an aerosol for inhalation by a user. Using charcoal to heat the tobacco may cause full or partial combustion of the tobacco or other ingredients. Additionally, charcoal may generate harmful or potentially harmful products, such as carbon monoxide, which may mix with the shisha vapor and pass through the water basin to the outlet.

One way to reduce the production of carbon monoxide and combustion by-products is to employ e-liquids rather than tobacco. Shisha devices that employ e-liquids eliminate combustion by-products but deprive shisha consumers of the traditional tobacco-based experience.

Other shisha devices have been proposed that employ electric heaters to heat, but not combust, tobacco. Such electrically heated heat-not-burn shisha devices heat the tobacco substrate to a temperature sufficient to produce an aerosol from the substrate without combusting the substrate, and therefore reduce or eliminate by-products associated with combustion of tobacco.

Shisha devices may employ a capsule for housing an aerosol-forming substrate. The capsule may be filled with such aerosol-forming substrate. The aerosol-forming substrate may comprise tobacco, preferably shisha substrate, such as molasses, a mixture of tobacco, water, sugar, and other components, such as glycerine, flavours, etc. The heating system of the electrically heated shisha device heats the contents of the capsule to generate aerosol, which is conveyed through an airflow path to a user.

In order to facilitate airflow through the capsule and the flow of the aerosol from the capsule, a shisha capsule may have one or more holes through one or more walls. Prior art capsules typically have one or more openings on at least one of the walls of the capsule, such as in one or both of the top and bottom walls. At least some of the holes or openings in the top and bottom walls may be closed by a removable (for example, peelable) sealing layer, such as a film, sticker, or liner, during storage.

Regardless of whether the shisha substrate is provided in a capsule with airflow inlets or outlets or whether the shisha substrate is provided in a loose form directly into a receptacle as in conventional shisha arrangements, unwanted debris such as aerosol-forming substrate or liquid may leak. This unwanted debris may contaminate the shisha, particularly if the debris or liquid enters a region downstream region of an airflow path of the shisha device. Unwanted debris may necessitate regular cleaning of the shisha.

It would be desirable to have a shisha device enabling improved cleaning of unwanted debris. It would be desirable to provide a shisha preventing or at least minimising unwanted debris from contaminating an airflow path of the shisha device.

According to an embodiment of the invention there is provided an aerosol-generating device. The aerosol-generating device may be a shisha device. The aerosol-generating device may comprise a cavity configured for receiving a capsule comprising an aerosol-forming substrate. The aerosol-generating device may comprise a trough in fluid communication with the cavity. The trough may be configured to be a debris receiving element. This debris receiving element may be able to receive debris originating from the capsule.

According to an embodiment of the invention there is provided a shisha device comprising a cavity configured for receiving a capsule comprising an aerosol-forming substrate. The shisha device further comprises a trough in fluid communication with the cavity.

The terms "downstream" and "upstream," are used in the following to describe the relative positions of components, or portions of components, of a shisha device in relation to the direction in which air flows when a user draws on the shisha device during use thereof. Shisha devices according to the invention have a downstream end through which, in use, an aerosol exits the shisha for delivery to a user, and have an opposite, upstream end. The downstream end of the shisha device may also be referred to as the mouth end. In use, a user draws on the downstream end of the shisha device in order to inhale an aerosol generated by the aerosol-forming substrate. The term "fluid communication" is used to describe that aerosol can flow between respective parts of the shisha device being in fluid communication, for example when a user draws on the shisha device.

Since the trough is in fluid communication with the cavity configured for receiving the capsule, the trough can easily receive one or both of debris and liquid aerosol former from the capsule. In particular, one or both of the debris and liquid aerosol former from the aerosol-forming substrate can drop into the trough due to one or both of gravity and airflow. This may provide a particular advantageous way of removing the debris. In some embodiments, the aerosol-forming substrate may comprise tobacco, as will later be described.

The trough may effectively collect debris and may therefore prevent one or both of the debris and liquid aerosol former from entering the liquid vessel or other parts of the shisha. Thus, the trough may prevent an unpleasant experience of the user caused by debris spread in the shisha device.

The trough may comprise an outer wall. The trough may comprise an inner wall facing the outer wall. The trough may comprise a bottom wall. The trough may comprise a cross-section with a distance between the outer wall and the inner wall being larger at the upstream end of the trough compared to the downstream end of the trough, for example, at the bottom wall. Furthermore, the cavity configured for receiving the capsule may be located upstream of the trough. Such a cross section of the trough may reliably ensure that one or both of the debris and liquid aerosol former from the aerosol-forming substrate can be received by the trough at its upstream end in a reliable way due to its larger cross-section at the upstream end. The larger cross-section may ensure that one or both of the debris and the liquid (for example, liquid aerosol former) originating from the capsule, received in the upstream cavity, are collected from a wider area. After having been collected by the wider upstream end of the trough, the debris and/or liquid aerosol former can be channeled in the trough towards the downstream end and the bottom wall having a smaller cross-section for storing purposes. In particular, the trough may comprise a conical or frusto-conical cross-section. The trough may comprise a cross-section with the opposing outer and inner wall being parallel to each other.

The cavity for receiving the capsule may comprise an upstream end face and a downstream end face. The upstream end face may simply be an open end. The cavity may receive the capsule through the upstream end face. The downstream end face may be an open or partially open end. The downstream end face may provide an interface for fluid communication with the trough.

The trough may improve the cleaning of the shisha as will be described in more detail below. The trough may reduce contamination of the airflow with debris from the aerosol-forming substrate.

In some embodiments the trough is arranged downstream of the cavity.

Such an embodiment of the shisha device of the invention may ensure that the debris can be collected in a simple way downstream of the cavity without being spread in other parts of the shisha device. The debris may be directly collected by the trough near to the capsule in the cavity. The debris may be collected without the need for being transported through further parts of the shisha device before being collected.

According to some embodiments of the invention, the trough comprises an annular shape. The annular shaped trough may be arranged surrounding the longitudinal central axis of the cavity. The trough may be centred about a longitudinal central axis of the cavity. Such an orientation of the central axis of the cavity relative to the trough may ensure that any debris from the capsule located in the cavity is particularly well collected by the trough.

The trough comprising the annular shape may be particularly well suited to collect the debris originating from different parts of the capsule. The trough may be arranged along the perimeter of the downstream end face of the cavity. The capsule may include one or more openings. Alternatively, one or more openings may be created in the capsule by an opening element. The one or more openings may serve to allow the air to enter the capsule and to pass through the capsule and exit the capsule after the formation of an aerosol. For example, if these openings are located in different parts of the capsule, then debris from these parts may advantageously be collected by one annular trough.

The outermost diameter of the annular shaped trough may correspond to or may be slightly larger than the diameter of the downstream end face of the cavity. Such a configuration may ensure that one or both of the debris and liquid aerosol former originating from different parts of the capsule are received in the trough in a reliable way.

The shisha device may comprise a first airflow channel in fluid communication with the cavity. The first airflow channel may guide the aerosol formed in the cavity through the shisha device. The first airflow channel may have a tubular shape. The first airflow channel may have a circular, oval or rectangular cross-section.

The first airflow channel may be configured as a central tubular airflow channel. The first airflow channel may be arranged along the longitudinal central axis of the cavity. The first airflow channel may be arranged along the longitudinal central axis of the shisha device. These spatial orientations of the first airflow channel relative to the cavity can ensure a reliable fluid connection between both elements.

The trough may be arranged around the first airflow channel. This may ensure that the trough reliably receives one or both of the debris and liquid aerosol former from the aerosol-forming substrate without the debris and aerosol former blocking the first airflow channel.

In particular, the first airflow channel may comprise an upstream end face. The upstream end face may neighbour the cavity for receiving the capsule. The first airflow channel also may include a downstream end face. The trough may surround a perimeter of the upstream end face of the first airflow channel. Such a spatial orientation of the upstream end face of the first airflow channel and the trough may ensure that most or all of the debris is received by the trough so that no or less debris from the capsule can enter the first airflow channel.

The shisha device furthermore may comprise a connection element. The connection element may comprise or may at least partially define the first airflow channel. The connection element may serve to connect the first airflow channel to other components of the shisha device. The connection element may serve to connect the first airflow channel to an airflow conduit, such as a stem pipe, of the shisha device. The connection element may be made of a polymeric material, such as plastic. The connection element may comprise PEEK. The connection element may be produced for example by injection molding or casting.

The connection element may be configured to be removably attachable to the shisha device. The connection element of the shisha device may comprise connectors. These connectors may serve to connect the connection element with other components of the shisha device.

The shisha device may comprise an opening element. Such an opening element can ensure that openings are created in the bottom portion of the capsule allowing the aerosol formed in the capsule to leave the capsule. Such an opening element may be required in the case that the capsule does not contain openings so that the openings are created when the capsule engages with the shisha device.

The opening element may be formed as a piercing element, as a cutting, slicing element or needle-shaped opening element, or any combination thereof. The opening element may comprise one or both of sharp edges for cutting the bottom portion of the capsule and tips for penetrating the bottom portion of the capsule.

The opening element may be located upstream of the trough. Therefore, the trough may be particularly well suited for receiving one or both of the debris and liquid parts of the aerosol-forming substrate originating from the capsule penetrated by the opening element.

The opening element may extend through the downstream end face of the cavity for receiving the capsule. Such a spatial arrangement of the opening element relative to the cavity may ensure that the opening element can penetrate the bottom portion of the capsule once the capsule is received in the cavity.

Furthermore, the opening element may be located upstream of the first airflow channel. This may ensure that the aerosol leaving the capsule via the holes created by the opening element can be further channelled through the shisha device by entering the first airflow channel.

The opening element may be elongate. The opening element may have an extension direction. The trough, preferably the annular shaped trough, may be arranged downstream in the extension direction of the opening element.

In such a configuration the trough may be located directly under the opening element. The trough may advantageously easily collect debris, such as liquid aerosol former, from the capsule.

The opening element may be located upstream of the upstream end face of the first airflow channel. Such a configuration ensures that the aerosol formed in the capsule can exit the capsule via openings created by the opening element and can further be channelled into the first airflow channel.

In a further embodiment, the trough of the shisha device may have a conically shaped outer wall. The outer wall may be located downstream of the opening element. The outer wall may be both conically shaped and located downstream of the opening element. Such a conically shaped outer wall may ensure that any debris or aerosol former released by the holes created by the opening element may slide down the conically shaped outer wall and be particularly easily collected at the bottom wall of the trough. This also might enable that no debris enters any other part of the shisha device except for the trough.

In some embodiments of the shisha device, the trough and the opening element may be integrally formed. In some embodiments, the outer wall of the trough and the opening element may be integrally formed. In some embodiments, the outer wall of the trough, in particular the conically shaped outer wall and the opening element may be integrally formed. The opening element and the outer wall of the trough may be formed as one single piece of the shisha device. Such a configuration may have the advantage, that the outer wall of the trough can support the opening element, so that the opening element can particularly well withstand the mechanical pressure while penetrating the bottom portion of the capsule. Furthermore, the outer wall, particularly if the outer wall is conical, may assist in the collection of any debris or liquid aerosol former originating from the hole generated by the opening element.

In some embodiments, the inner wall, the outer wall, the bottom wall of the trough and the opening element may be formed integrally. The trough and the opening element therefore may form one single piece of the shisha device. This might ensure, that the outer wall of the trough can particularly well stabilize the opening element. Furthermore, any debris and aerosol former originating from a hole created by the opening element in the bottom portion of the capsule might exclusively be collected by the trough and therefore might not enter any other parts of the shisha device.

Additionally, the single piece of the shisha device comprising the outer wall, the inner wall, the bottom wall and the opening element may also be configured to be removably attachable to the shisha device. This might enable a particular easy replacement of the single piece in the case that for example the opening element being broken. Furthermore, this also might facilitate an easy cleaning of one or both of the opening element and the trough.

The single piece described in either of the preceding paragraphs comprising both the trough and the opening element may be mountable into a slot of the connection element. This may facilitate an easy positioning of the opening element and the trough relative to the first airflow channel included in the connection element. Furthermore, this also might reliably position the opening element upstream of the upstream end face of the first airflow channel.

In some embodiments, the slot in the connection element may comprise an annular shape. The slot with the annular shape may surround a perimeter of the upstream end face of the first airflow channel in the connection element. This configuration might enable a reliable positioning of the integral single piece comprising the trough and the opening element relative to the connection element with the first airflow channel.

In some embodiments, a plurality of at least two opening elements might be present in the shisha device. These at least two opening elements might serve to cut or slice open different parts of the bottom portion of the capsule.

The plurality of at least two opening elements may be located around the perimeter of said upstream end face of the first airflow channel. The plurality of opening elements may surround the perimeter of the upstream end face of the first airflow channel. Such an arrangement of the opening elements relative to the upstream end face of the first airflow channel can ensure that any aerosol exiting the capsule via openings created by the opening elements can be directed easily into the first airflow channel.

The plurality of opening elements may be connected with each other by a ring-like structure. This structure may advantageously serve to increase the stability of the plurality of opening elements. In particular, the interconnected plurality of opening elements may form of a crown, such as a ring-shaped crown. The crown may comprise a plurality of opening elements, for example at least 2, 3, 4, 5, 6 or more opening elements. The plurality of opening elements may be arranged in a ring-like manner on the crown.

The plurality of opening elements may be arranged for engaging a region at or proximal to the perimeter of the bottom portion of the capsule received in the cavity. The plurality of opening elements may be arranged uniformly around the perimeter of the ring-like structure. The plurality of opening elements may open different parts of the bottom portion of the capsule when the capsule is received in the cavity of the shisha device.

The crown of the plurality of opening elements may be integrally formed with the outer wall of the trough, which may be conically shaped. Similarly, the crown of the plurality of opening elements may be integrally formed with the outer wall, the inner wall and the bottom wall of the trough into one single piece.

In the case of a plurality of opening elements being part of a crown, the trough preferably may be formed as an annular-shaped trough downstream of the plurality of opening elements. In such a configuration the single annular-shaped trough can receive the debris from different parts of the penetrated capsule enabling a particular easy way of collecting the debris.

The opening element or the plurality of opening elements may be made of a stable material able to withstand the mechanical stress when penetrating the capsule. Preferably, the opening elements are made of metal, preferably stainless steel. Such a material is particularly stable and able to penetrate the capsule and furthermore can easily be cleaned.

The trough, in particular its outer wall, inner wall and bottom wall may be formed of one or more of: metal, plastic, thermal resistive polymer. In particular, thermal resistive polymer may comprise polyetherether ketone (PEEK). These materials are able to withstand the higher temperatures in the shisha device during operation.

The connection element comprising the first airflow channel further might comprise one or both of the inner wall and the bottom wall of the trough. This may enable a space-saving design, wherein both the first airflow channel as well as parts of the trough are included in the connection element.

In particular, it might be possible that parts of the slot of the connection element might form one or both of the inner wall and the bottom wall of the trough. For example, it might be possible to mount the conically shaped outer wall and the opening element which are integrally formed into the slot. In this case the inner wall as well as the bottom wall of the trough might be formed by an inner wall and bottom wall of the slot, whereas the outer wall of the trough may be the conically shaped outer wall.

The inner wall of the trough may also form an upstream portion of the first airflow channel. This design is particularly space-saving and enables to house two different elements of the shisha device, parts of the trough and the airflow channel in close proximity.

The cavity for receiving the capsule may comprise one or more sidewalls. These sidewalls may abut a capsule when the capsule is received in the cavity. The sidewalls of the cavity may comprise a conical shape. These sidewalls exhibiting a conical shape are particularly well suited to house a capsule having an overall conical or frustoconical shape. Additionally, sidewalls of the cavity having such a shape also may be able to reliably position a capsule within the cavity without any danger of the capsule shifting within the cavity.

The cavity for receiving the capsule may include an upstream end face and a downstream end face. The diameter of the downstream end face of the cavity may be smaller than the diameter of the upstream end face of the cavity. Such a design may ensure that a capsule with a conical or frustoconical shape can be particularly well housed in the cavity. The downstream end face of the cavity may align with the bottom portion of a capsule housed therein. Additionally, the upstream end face of the cavity may align with the top portion of a capsule housed therein.

In some embodiments, the upstream end face of the first airflow channel may be spaced apart from the downstream end face of the cavity. This may ensure that a gap is created between the downstream end of the cavity and the first airflow channel in order to provide space for the aerosol leaving the capsule to enter the first airflow channel.

In some embodiments, the trough may be located downstream of the downstream end face of the cavity. Such a configuration may ensure that the debris and the aerosol former from the capsule are received by the trough.

The first airflow channel of the shisha device may abut a second airflow channel of the shisha device. The first airflow channel may be in fluid communication with the second airflow channel of the shisha device. The first airflow channel may be fluidly connected with the second airflow channel of the shisha device. The second airflow channel of the shisha device may guide the aerosol produced by the aerosol-forming substrate further downstream in the shisha device. Such a second airflow channel for example may direct the aerosol into a liquid vessel partly filled with a liquid such as water. The second airflow channel may comprise or may be part of a stem pipe. The stem pipe may comprise one or more connectors or connecting regions for connecting the stem pipe to the connection element with the first airflow channel.

Such a configuration may ensure that the trough can be located downstream of the cavity but upstream of an extended tubular second airflow channel of the shisha device directing the aerosol for example into a liquid vessel.

The trough may be arranged between the opening element and the stem pipe. Such a configuration may enable the trough to collect the debris without the debris entering and potentially clogging the second airflow channel of the stem pipe.

The trough may comprise an absorption element. The absorption element may be configured to absorb fluid originating from the penetrated capsule, for example liquid aerosol former. In some embodiments, the absorption element may be configured to absorb pressure from the opening element during the process of penetrating the capsule.

The absorption element may be arranged in the annular-shaped trough. The absorption element may be arranged at or adjacent the bottom wall of the annular-shaped trough. The absorption element may be disposed in a deepest portion of the trough. The absorption element may advantageously enable a quick and easy absorption of fluids from the penetrated capsule. The absorption element may facilitate one or both of holding and supporting the outer wall of the trough. Furthermore, the absorption element also might support the opening element, especially when the outer wall of the trough and the opening element are integrally formed.

The absorption element may be removable. Advantageously, a removable absorption element can easily be replaced with a clean absorption element once the existing absorption element has become soiled or saturated.

The absorption element may be shaped as a ring. The absorption element may have a diameter and a thickness enabling the absorption element to be inserted into the annular-shaped trough. Such an absorption element is particularly well suited to position the outer wall of the trough.

In some embodiments, the absorption element comprises a capillary material such as a liquid retention material, or a high liquid retention material (HRM). In some embodiments, the capillary material may be, or may comprise, a porous or fibrous material that absorbs or otherwise retains a liquid that it is brought into contact with.

In some embodiments, the opening element may include a relatively sharp tip for piercing the capsule protruding from the opening element. Such a sharp tip may enable the opening element to reliably open the material of the capsule when the capsule is placed in the cavity of the shisha device. The opening element may comprise two side frames protruding from the opening element and flanking the sharp tip. These two side frames may assist in opening a broader area of the capsule thereby assisting in creating a third airflow channel for generation of the aerosol running through the capsule. The two side frames may improve stability of the opening element. The two side frames together with the section including the sharp tip may comprise a U-shaped cross section of the opening element. These two side frames together with the section including the tip may protrude towards the capsule when the capsule is placed in the cavity of the shisha device. A U-shaped cross-section may reliably open a large part of the bottom portion of the capsule, which comes in contact with the U-shaped opening element.

Alternatively, or additionally, the opening element may comprise sharp edges. These edges might serve to slice open parts of the bottom portion of the capsule.

The shisha device may comprise a head portion including at least one, preferably all of, the following elements: the cavity for receiving the capsule, a lid portion closing the cavity, the opening element, the trough and heating means for heating the capsule received in the cavity. The head portion may be able to be disassembled into the different elements which are included therein. If the head portion of the shisha device may easily be disassembled into the different elements, the trough may easily be accessed and may be cleaned. Additionally, any element of the head portion, including the connection element with the first airflow channel can also easily be replaced if it is broken without the need to replace the entire head portion.

According to another embodiment, the connection element with the first airflow channel comprises more than one snap nose, for example at least two, at least three, or at least 4 snap noses. These additional snap noses may ensure a much tighter and more stable connection to other parts of the shisha device.

The connection element with the first airflow channel may have a tubular shape.

The shisha device may comprise heating means, such as an electrical heating means. The heating means may be configured for heating the capsule received in the cavity. The heating means may at least partly surround the cavity for receiving the capsule. The heating means may be in thermal contact with the cavity. In one or more embodiments, at least a part of the cavity for receiving the capsule may be surrounded by the electrical heating means. The cavity may be cylindrical. Preferably, the cavity may be conical. The heating means may be arranged surrounding the cavity. The heating means may be arranged surrounding the sidewall of the cavity. The heating means may form the sidewall of the cavity.

Preferably, the heating means comprises a resistive heating means. For example, the heating means may comprise one or more resistive wires or other resistive elements. The resistive wires may be in contact with a thermally conductive material to distribute heat produced over a broader area. Examples of suitable conductive materials include aluminum, copper, zinc, nickel, silver, and combinations thereof. For purposes of this invention, if resistive wires are in contact with the thermally conductive material, both the resistive wires and the thermally conductive material are part of heating means that surrounds at least a portion of the cavity for receiving the capsule.

In some examples, the heating means comprises an inductive heating means. For example, the heating means may comprise susceptor material that surrounds at least a part of the cavity for receiving the capsule. As used herein, the term "susceptor" refers to a material that is capable to convert electromagnetic energy into heat. When located in an alternating electromagnetic field, typically eddy currents are induced and hysteresis losses may occur in the susceptor causing heating of the susceptor. As the susceptor is located in thermal contact or close thermal proximity with the aerosol-forming substrate of the capsule, the substrate is heated by the susceptor such that an aerosol is formed. Preferably, the susceptor is arranged at least partially in direct physical contact with the capsule including the aerosol-forming substrate.

The susceptor may be formed from any material that can be inductively heated. Preferably, the susceptor may be formed from any material that can be inductively heated to a temperature sufficient to generate an aerosol from the aerosol-forming substrate. Preferred susceptors comprise a metal or carbon. A preferred susceptor may comprise or consist of a ferromagnetic material, for example ferritic iron, ferromagnetic alloy, such as ferromagnetic steel or stainless steel, a ferrite. A suitable susceptor may be, or comprise, aluminium.

Preferred susceptors are metal susceptors, for example stainless steel. However, susceptor materials may also comprise or be made of graphite, molybdenum, silicon carbide, aluminium, niobium, Inconel alloys (austenite nickel-chromium-based superalloys), metallized films, ceramics such as for example zirconium, transition metals such as for example Fe, Co, Ni or metalloids components such for example B, C, Si, P, Al.

A susceptor preferably comprises more than 5%, preferably more than 20%, preferably more than 50% or 90% of ferromagnetic or paramagnetic materials. Preferred susceptors may be heated to a temperature in excess of 250° C. Suitable susceptors may comprise a non-metallic core with a metal layer disposed on the non-metallic core, for example metallic tracks formed on the surface of a ceramic core.

The shisha device may also comprise one or more induction coils configured to induce eddy currents and/or hysteresis losses in the susceptor material, which results in heating of the susceptor material. In some embodiments, a susceptor material may be positioned in the capsule containing the aerosol-forming substrate. A susceptor element comprising the susceptor material may comprise any suitable material, such as those described in, for example, PCT published patent applications WO 2014/102,090 and WO 2015/177,255.

The heating means, whether a resistive or inductive heating means, or both resistive and inductive heating means, may comprise a heating block. The heating block may comprise any suitable thermally conductive material. In some embodiments, the heating block comprises aluminum, alumina, or an alumina ceramic. The heating block may at least partly surround the cavity for receiving the capsule.

Preferably, the cavity for receiving the capsule may at least partly be surrounded either by the abovementioned heating block, the thermally conductive material for heating via resistive heating means or the susceptor material for inductive heating. The cavity for receiving the capsule may at least partly be surrounded in such a way that one or more of the heating block, the thermally conductive material and the susceptor material forms a tubular, preferably a conical, element. The top part of the tubular element, the upstream end face of the cavity may be open for inserting the capsule. The bottom portion of the tubular element, the downstream end face of the cavity may be open in order to receive the opening elements for penetrating the bottom portion of the capsule. The trough may be arranged further downstream.

The shisha device may heat the aerosol-forming substrate of the capsule by the above mentioned heating means to generate an aerosol. In some embodiments, the aerosol-forming substance is preferably heated, to a temperature in a range from about 150° C. to about 250° C.; more preferably from about 180° C. to about 230° C. or from about 200° C. to about 230° C.

The shisha device may comprise a lid portion covering the top section of the cavity for receiving the capsule. The lid portion may be removably attached to the top part of the shisha, in particular the cavity for receiving the capsule. The lid portion may be able to close the cavity after insertion of the capsule.

Preferably, the lid portion of the shisha device may include at least one outside air inlet. This outside air inlet may enable external air from outside the shisha device to enter the cavity housing the capsule. The external air may enter the capsule and form an aerosol upon heating of the aerosol-forming substrate contained in the capsule.

The lid portion furthermore may comprise at least one further opening element. The further opening element might be configured for penetrating and opening the top portion of the capsule. This may enable one or both of air and other gases to enter the capsule and to form the aerosol upon heating of the aerosol-forming substrate located in the capsule. Alternatively, or additionally, the capsule may comprise apertures in the top portion of the capsule allowing one or both of air and other gases to enter the interior of the capsule. The apertures in the top portion of the capsule may be covered during storage in order to prevent aerosol-forming substrate stored in the capsule from spilling out of the capsule. In addition, or alternatively, the apertures in the top portion of the capsule may have dimensions sufficiently small to prevent or inhibit the aerosol-forming substrate from exiting the capsule. If the apertures are covered, a consumer may remove the cover prior to inserting the capsule into the cavity of the shisha device.

In one embodiment of the invention, the capsule may comprise a top portion, a central portion and a bottom portion. The central portion may have a tubular form. Such a tubular form is particularly well suited in order to store a sufficient amount of aerosol-forming substrate.

The top portion of the capsule may comprise a flat shape. In some embodiments, the top portion of the capsule may include a rim. Such a rim may enable the mounting of a cover on the top portion of the capsule for sealing the capsule.

The bottom portion of the capsule may comprise a conical shape, in particular a conical shape wherein the tip of the conus is replaced by flat base for engaging with the opening elements of the shisha device located in the bottom portion of the cavity for receiving the capsule. This shape is also called a frusto-conical shape.

Preferably, the capsule comprises a thermally conductive body. For example, the body may comprise any one of: aluminium, copper, zinc, nickel, silver, and combinations of one or more thereof. Preferably, the body comprises aluminium. In some embodiments, the capsule comprises one or more materials less thermally conductive than aluminium. For example, the body may comprise any suitable thermally stable polymeric material. If the material is sufficiently thin that sufficient heat may be transferred through the body of the capsule to the aerosol-forming substrate housed therein, despite the body being formed from material that is not particularly relatively thermally conductive.

Preferably, the central portion and the bottom portion of the capsule are formed as one-piece. The top portion of the capsule may be sealed by a cover, for example a thin metal foil.

The body of the capsule is preferably made of an outer shell which is so thin that it can easily be opened by the opening element of the shisha device.

Generally, any suitable aerosol-forming substrate may be housed in the capsule in accordance with the invention. The aerosol-forming substrate is preferably a substrate capable of releasing volatile compounds that may form an aerosol. The volatile compounds may be released by heating the aerosol-forming substrate. The aerosol-forming substrate may be solid or liquid or comprise both solid and liquid components. Preferably, the aerosol-forming substrate comprises a solid.

The aerosol-forming substrate may comprise nicotine. The nicotine containing aerosol-forming substrate may comprise a nicotine salt matrix. The aerosol-forming substrate may comprise plant-based material. The aerosol-forming substrate preferably comprises tobacco, and preferably the tobacco containing material contains volatile tobacco flavor compounds, which are released from the aerosol-forming substrate upon heating. The aerosol-forming substrate may comprise homogenized tobacco material. Homogenized tobacco material may be formed by agglomerating particulate tobacco. The aerosol-forming substrate may alternatively or additionally comprise a non-tobacco-containing material. The aerosol-forming substrate may comprise homogenized plant-based material.

The aerosol-forming substrate may comprise, for example, one or more of: powder, granules, pellets, shreds, spaghettis, strips or sheets containing one or more of: herb leaf, tobacco leaf, fragments of tobacco ribs, reconstituted tobacco, homogenized tobacco, extruded tobacco and expanded tobacco.

The aerosol-forming substrate may comprise at least one aerosol-former. The aerosol-former may be any suitable known compound or mixture of compounds that, in use, facilitates formation of a dense and stable aerosol and that is substantially resistant to thermal degradation at the operating temperature of the shisha device. Suitable aerosol-formers are well known in the art and include, but are not limited to: polyhydric alcohols, such as triethylene glycol, 1,3-butanediol and glycerol; esters of polyhydric alcohols, such as glycerol mono-, di- or triacetate; and aliphatic esters of mono-, di- or polycarboxylic acids, such as dimethyl dodecanedioate and dimethyl tetradecanedioate. Particularly preferred aerosol formers are polyhydric alcohols or mixtures thereof, such as triethylene glycol, 1,3-butanediol and, most preferred, glycerol. The aerosol-forming substrate may comprise other additives and ingredients, such as flavorants. The aerosol-forming substrate preferably comprises nicotine and at least one aerosol-former. In a particularly preferred embodiment, the aerosol-former is glycerol.

The aerosol-forming substrate may comprise any suitable amount of an aerosol-former. For example, the aerosol-former content may be equal to or greater than 5% on a dry weight basis, and preferably between greater than 30% by weight on a dry weight basis. The aerosol-former content may be less than about 95% on a dry weight basis. Preferably, the aerosol-former content is up to about 55%.

The aerosol-forming substrate may be provided on or embedded in a thermally stable carrier. The carrier may comprise a thin layer on which the substrate deposited on a first major surface, on second major outer surface, or on both the first and second major surfaces. The carrier may be formed of, for example, a paper, or paper like material, a non-woven carbon fiber mat, a low mass open mesh metallic screen, or a perforated metallic foil or any other thermally stable polymer matrix. Alternatively, the carrier may take the form of powder, granules, pellets, shreds, spaghettis, strips or sheets. The carrier may be a non-woven fabric or fiber bundle into which tobacco components have been incorporated. The non-woven fabric or fiber bundle may comprise, for example, carbon fibers, natural cellulose fibers, or cellulose derivative fibers.

In some examples, the aerosol-forming substrate comprises one or more sugars in any suitable amount. Preferably, the aerosol-forming substrate comprises invert sugar, which is a mixture of glucose and fructose obtained by splitting sucrose. Preferably, the aerosol-forming substrate comprises from about 1% to about 40% sugar, such as invert sugar, by weight. In some example, one or more sugars may be mixed with a suitable carrier such as cornstarch or maltodextrin.

In some examples, the aerosol-forming substrate comprises one or more sensory-enhancing agents. Suitable sensory-enhancing agents include flavorants and sensation agents, such as cooling agents. Suitable flavorants include natural or synthetic menthol, peppermint, spearmint, coffee, tea, spices (such as cinnamon, clove and/or ginger), cocoa, vanilla, fruit flavors, chocolate, eucalyptus, geranium, eugenol, agave, juniper, anethole, linalool, and any combination thereof.

In some examples, the aerosol-forming substrate is in the form of a suspension. For example, the aerosol-forming substrate may be in the form of a molasses. As used herein, "molasses" means an aerosol-forming substrate composition comprising about 25% or more sugar. For example, the molasses may comprise at least about 30% by weight sugar, such as at least about 40% by weight sugar. Typically, the molasses will contain less than about 60% by weight sugar, such as less than about 50% by weight sugar.

The term "tobacco material" refers to a material or substance comprising tobacco, which comprises tobacco blends or flavoured tobacco, for example.

As used herein, the term "aerosol" as used when discussing a flow of aerosol, may refer to aerosol, air containing aerosol or vapour, or aerosol-entrained air. Air containing vapour may be a precursor to air containing aerosol, for example, after being cooled or after being accelerated.

In one or more embodiments, the shisha device may further comprise the second airflow channel and a liquid vessel.

In use, the generated aerosol may flow through the second airflow channel. The second airflow channel may be a stem pipe, or may be part of a stem pipe. The second airflow channel comprises an upstream end portion defining a upstream opening positioned to receive airflow from the capsule housed in the cavity. The second airflow channel comprises a downstream end portion defining a downstream opening positioned in an interior of a vessel. The vessel is configured for receiving a liquid therein, up to a liquid fill level. The second airflow channel is in fluid communication with the vessel. The second airflow channel may be defined between the head portion of the shisha device and the interior of the vessel. In particular, the head portion, in particular the cavity for receiving the capsule is in fluid communication with the vessel, by means of the second airflow channel. The interior of the vessel comprises a lower volume for receiving liquid and an upper volume for head space. The vessel comprises a head space outlet in fluid communication with the upper volume of the vessel, above the liquid fill level. In some embodiments, a hose may be connected to the head space outlet. A mouthpiece may be coupled to the hose for puffing on by a user of the shisha device.

The vessel may include an optically transparent or opaque housing to allow a consumer to observe contents contained in the vessel. The vessel may include a liquid fill demarcation, such as a liquid fill line. The vessel housing may be formed of any suitable material. For example, the vessel housing may include glass or suitable rigid plastic material. Preferably, the vessel is removable from a portion of the shisha device including the head portion to allow a consumer to fill or clean the vessel.

The vessel may be filled to a liquid fill level. The liquid preferably comprises water, which may optionally be infused with one or more colorants, flavourants, or colorant and flavourants. For example, the water may be infused with one or both of botanical or herbal infusions. In some embodiments, the aerosol may be altered by being pulled through the liquid.

Air may be flowed through the cavity housing the capsule to draw aerosol from the capsule through the second airflow channel. Airflow may exit the shisha device through a head space outlet of the vessel. Air may flow through the second airflow channel by application of a negative pressure at the head space outlet. The source of negative pressure may be suction or puffing of a user. In response, aerosol may be drawn through the second airflow channel, through the liquid contained in the interior of the vessel. The user may suck on a mouthpiece in fluid communication with the head space outlet to generate or provide the negative pressure at the head space outlet or mouthpiece. In some embodiments, airflow may enter the capsule housed in the cavity of the shisha device including an aerosol-forming substrate. Subsequently, the air may flow along or across the aerosol-forming substrate, and may become entrained with aerosol. Aerosol-entrained air may then flow through a hole created by the opening element through the first airflow channel followed by the second airflow channel, to the vessel.

The shisha device may comprise control electronics operably coupled to the above described heating means. The control electronics are configured to control heating of the heating means.

The control electronics may be provided in any suitable form. The control electronics may comprise a controller. The control electronics may comprise a memory. The memory may comprise instructions that cause one or more components of the shisha device to carry out a function or aspect of the control electronics. Functions attributable to control electronics in this disclosure may be embodied as one or more of software, firmware, and hardware. The memory may be a non-transient computer readable storage medium.

In particular, one or more of the components, such as controllers, described herein may comprise a processor, such as a central processing unit (CPU), computer, logic array, or other device capable of directing data coming into or out of the control electronics. The controller may comprise one or more computing devices having memory, processing means, and communication hardware. The controller may comprise circuitry used to couple various components of the controller together or with other components operably coupled to the controller. The functions of the controller may be performed by hardware. The functions of the controller may be performed by instructions stored on a non-transient computer readable storage medium. The functions of the controller may be performed by both hardware and by instructions stored on a non-transient computer readable storage medium.

Where the controller comprises a processor, the processor may, in some embodiments, comprise any one or more of a microprocessor, a microcontroller, a digital signal processor (DSP), an application specific integrated circuit (ASIC), a field-programmable gate array (FPGA), and equivalent discrete or integrated logic circuitry. In some embodiments, the processor may comprise multiple components, such as any combination of one or more microprocessors, one or more controllers, one or more DSPs, one or more ASICs, and one or more FPGAs, as well as other discrete or integrated logic circuitry. The functions attributed to the controller or processor herein may be embodied as software, firmware, hardware, or any combination thereof. While described herein as a processor-based system, an alternative controller could utilize other components such as relays and timers to achieve the desired results, either alone or in combination with a microprocessor-based system.

In one or more embodiments, the exemplary systems, methods, and interfaces may be implemented using one or more computer programs using a computing apparatus, which may comprise one or more processors, memory, or both memory and one or more processors. Program code, logic or both code and logic described herein may be applied to input data or information to perform functionality described herein and generate desired output data/information. The output data or information may be applied as an input to one or more other devices or methods as described herein or as would be applied in a known fashion. In view of the above, it will be readily apparent that the controller functionality as described herein may be implemented in any manner known to one skilled in the art.

In some embodiments, the control electronics may comprise a microprocessor, which may be a programmable microprocessor. The electronic circuitry may be configured to regulate a supply of power. The power may be supplied to the heater element or induction coil in the form of pulses of electrical current.

If the heating means for the capsule comprises a resistive heating element, in some embodiments, the control electronics may be configured to measure or monitor the electrical resistance of the heating element. In some embodiments, the control electronics may be configured to control the supply of power to the heating means depending on the electrical resistance of the heating means. In this manner, the control electronics may regulate the temperature of the resistive element.

If the heating means comprise an induction coil and the heating means comprises a susceptor material, in some embodiments, the control electronics may be configured to monitor one or more aspects of the induction coil. In some embodiments, the control electronics may be configured to control the supply of power to the induction coil depending on the aspects of the coil such as described in, for example, WO 2015/177,255. In this manner, the control electronics may regulate the temperature of the susceptor material.

The shisha device may comprise a cooling element. The cooling element may be disposed along the second airflow channel. The cooling element may integrally form part of the second airflow channel. The cooling element is configured to cool aerosol in the second airflow channel, particularly air that flows through or past the cooling element. The cooling element may be disposed downstream from the cavity for receiving the capsule along the second airflow channel. In particular, the cooling element may be disposed between the cavity for receiving the capsule and the end of the second airflow channel, or at least between the cavity for receiving the capsule and the vessel. Further, the cooling element may be positioned adjacent to, or as close as possible, to a deceleration chamber, or deceleration portion of the stem pipe, which may promote rapid cooling for aerosol production. The cooling element may utilize passive cooling, active cooling, or both. The cooling element may comprise a conduit of thermally conductive material.

The shisha device may comprise a temperature sensor. The temperature sensor may comprise a thermocouple. The temperature sensor may be operably coupled to the control electronics to control the temperature of the heating means. The temperature sensor may be positioned in any suitable location. For example, the temperature sensor may be configured to insert into the aerosol-forming substrate or a capsule received within the cavity to monitor the temperature of the aerosol-forming substrate being heated. In addition, or alternatively, the temperature sensor may be in contact with the means for heating. In addition, or alternatively, the temperature sensor may be positioned to detect temperature at an aerosol outlet of the shisha device, such as the mouthpiece. In addition, or alternatively, the temperature sensor may be in contact with the cooling element, such as the heated side of the heat pump. The sensor may transmit signals regarding the sensed temperature to the control electronics, which may adjust the heating means to achieve a suitable temperature at the sensor.

Any suitable thermocouple may be used, such as a K-type thermocouple. The thermocouple may be placed in the capsule where the temperature is lowest. For example, the thermocouple may be placed in the centre, or middle, of the capsule.

Regardless of whether the shisha device comprises a temperature sensor, the device is preferably configured to heat an aerosol-forming substrate in a capsule received in the cavity to an extent sufficient to generate an aerosol without combusting the aerosol-forming substrate.

The control electronics may be operably coupled to a power supply of the shisha device. The shisha device may comprise any suitable power supply. For example, a power supply of a shisha device may be a battery or set of batteries (such as a battery pack). In some embodiments, one or more than one component of the battery, such as the cathode and anode elements, or even the entire battery may be adapted to match geometries of a portion of a shisha device in which they are disposed. In some cases, the battery or battery component may be adapted by rolling or assembling to match geometries. The batteries of power supply unit may be rechargeable. The batteries of the power supply may be removable and replaceable. Any suitable battery may be used. For example, heavy duty type or standard batteries existing in the market, such as used for industrial heavy duty electrical power-tools. Alternatively, the power supply unit comprise be any type of electric power supply comprising a super or hyper-capacitor. In some embodiments, the shisha device may be connectable to an external electrical power source, and electrically and electronically designed for such purpose. Regardless of the type of power supply employed, the power supply preferably provides sufficient energy for the normal functioning of the shisha device for at least approximately 30 minutes, preferably at least approximately 50 minutes, more preferably for at least approximately 70 minutes of continuous operation of the device, before being recharged or needing to connect to an external electrical power source.

The shisha device may comprise an accelerating element. Aerosol-entrained air may depressurize upon passing through one or more accelerating elements. The aerosol-entrained air then continues through a stem pipe, into the vessel, and then may be inhaled by the user. The accelerating element may be positioned along the second airflow channel. The accelerating element may integrally form part of the second airflow channel. The accelerating element may be configured to accelerate aerosol that flows through the accelerating element.

In some examples, a user may activate one or more heating means for the capsule by using an activation element on, for example, the mouthpiece. The activation element may be, for example, in wireless communication with the control electronics and may signal control electronics to activate the heating means from standby mode to full heating. Preferably, such manual activation is only enabled while the user puffs on the mouthpiece to prevent overheating or unnecessary heating of aerosol-forming substrate in the capsule.

In some examples, the mouthpiece comprises a puff sensor in wireless communication with the control electronics and puffing on the mouthpiece by a consumer causes activation of the heating means from a standby mode to full heating.

A shisha device of the invention may have any suitable air management. In one example, puffing action from the user will create a suction effect causing a low pressure inside the device which will cause external air to flow through an outside air inlet of the device, into the cavity for receiving the capsule. The air may then flow through the aerosol-forming substrate to carry aerosol through the aerosol outlet of the cavity and along the opening element and the trough through the first airflow channel. The aerosolized air then may exit the cavity and flow through the second airflow channel to the liquid inside the vessel. The aerosol will then bubble out of the liquid and into head space in the vessel above the level of the liquid, out the headspace outlet, and through the hose and mouthpiece for delivery to the consumer. The flow of external air and the flow of the aerosol inside the shisha device may be driven by the action of puffing from the user.

Preferably, assembly of all main parts of a shisha device of the invention assures hermetic functioning of the device. Hermetic function should assure that proper air flow management occurs. Hermetic functioning may be achieved in any suitable manner. For example, seals such as sealing rings and washers maybe used to ensure hermetic sealing.

Sealing rings and sealing washers or other sealing elements may be made of any suitable material or materials. For example, the seals may include one or more of graphene compounds and silicon compounds. Preferably, the materials are approved for use in humans by the U.S. Food and Drug Administration.

Main parts, such as the cavity, or both of the first and second airflow channel from the cavity, the connection element, a lid portion for the cavity for receiving the capsule, and the vessel may be made of any suitable material or materials. For example, these parts may independently be made of glass, glass-based compounds, polysulfone (PSU), polyethersulfone (PES), or polyphenylsulfone (PPSU). Preferably, the parts are formed of materials suitable for use in standard dish washing machines.

In some examples, a mouthpiece of the invention incorporates a quick coupling male/female feature to connect to a hose unit.

The invention may further relate to an aerosol-generating system, which comprises a shisha device as disclosed herein and a capsule comprising an aerosol-forming substrate. The capsule may comprise a top portion and a bottom portion. The bottom portion of the capsule may be located upstream of the trough when the capsule is received in the cavity.

The shisha device of the aerosol-generating system of the invention may furthermore comprise an opening element as described herein. The opening element engages with the bottom portion of the capsule, when the capsule is received by the cavity.

Furthermore, the invention may further relate to a method of operating a shisha device according to any embodiment of the present invention. The method may employ at least a shisha device comprising a cavity configured for receiving a capsule comprising an aerosol-forming substrate, the shisha device comprising a heating element;

a trough in fluid communication with the cavity, and a mouthpiece being in fluid communication with the cavity for receiving the capsule, the method of operating said shisha device may comprise the steps:

a) placing a capsule in the cavity, b) providing an air inlet in the top portion and an opening in the bottom portion of the capsule, c) heating the capsule, d) drawing in air through the mouthpiece, thereby creating an inhalable aerosol, wherein debris originating from the aerosol-forming substrate is received by the trough.

Such a method ensures that the debris originating from the aerosol-forming substrate is received by the trough and is not transported further downstream towards the mouthpiece operated by the user. Therefore, an unpleasant experience for the user during operation of the shisha device and inhaling the aerosol can be avoided.

In one or more embodiments of the method of operating a shisha device, the shisha device furthermore comprises a lid portion with a further opening element wherein during method step b) the lid portion is closed above the cavity, thereby opening the top portion of the capsule and creating the air inlet.

Such an embodiment of the method of operating a shisha device provides a particular easy method of providing an air inlet in the top portion of the capsule by closing the lid portion of the cavity. Preferably, the lid portion comprises at least one outside air inlet enabling air from the outside of the shisha device entering the cavity housing the capsule.

Alternatively, or additionally, a method of operating a shisha device is disclosed wherein the top portion of the capsule comprises an air inlet sealed by a cover wherein during method step b) the cover is removed, thereby exposing the air inlet of the capsule. Similarly, the bottom portion of the capsule also might comprise openings sealed by a cover, whererein during method step b) the cover is removed, thereby exposing the openings of the capsule. Alternatively, at least one opening element might be present in the shisha device providing openings in the bottom portion of capsule.

Preferably when operating the shisha device, the air flow passes along the trough and one or both of the debris and liquid matter is received by said trough due to one or both of gravity and airflow. This provides a particular easy and reliable method for receiving the debris.

Features described in relation to one embodiment may equally be applied to other embodiments of the invention.

The invention will be further described, by way of example only, with reference to the accompanying drawings in which.

Figure 1A:
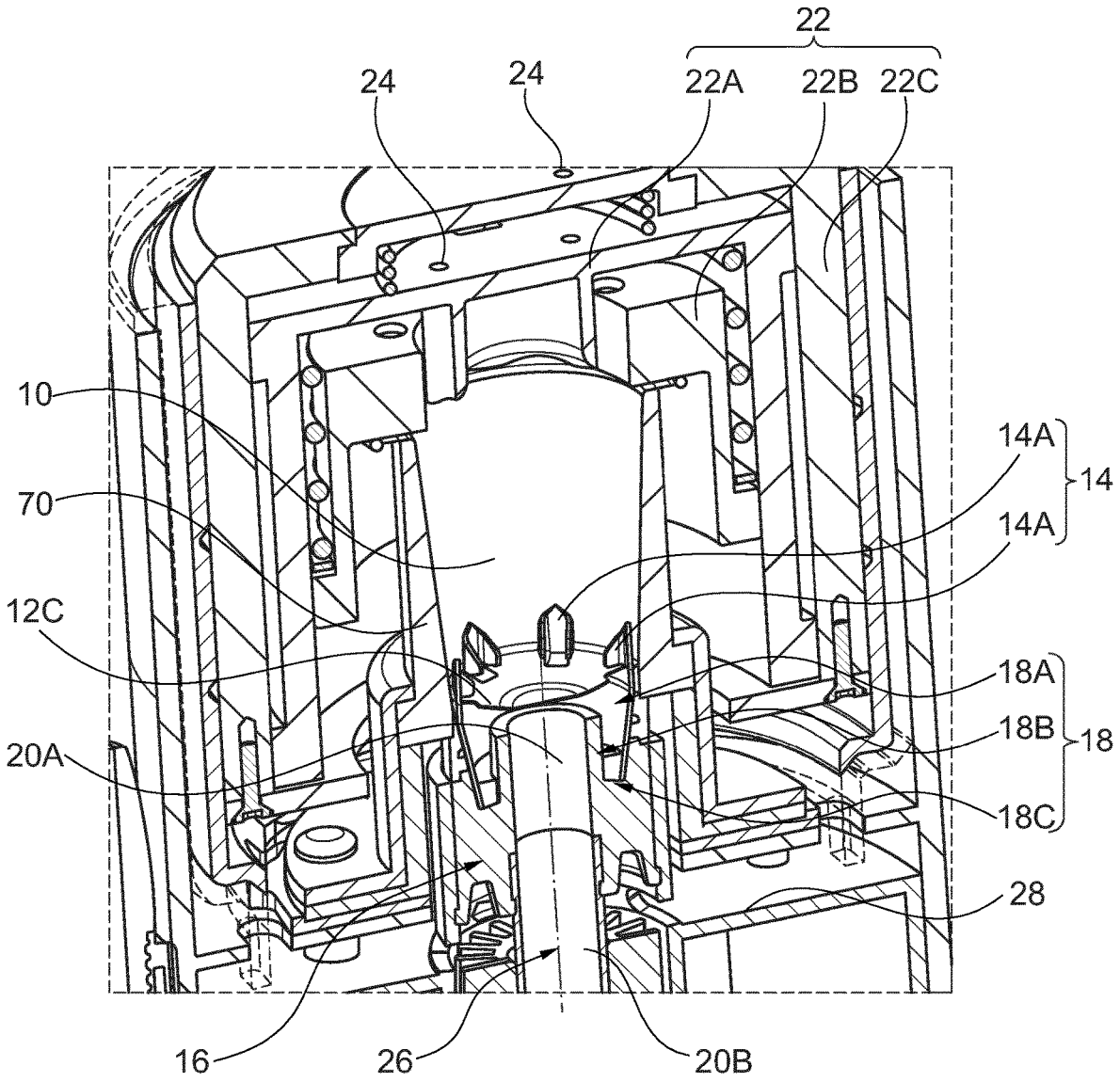
FIG. 1A shows a cut-out of a perspective view of a head portion of a shisha device of the invention including a connection element including the first airflow channel.

FIG. 1A shows a cut-out of a perspective view of a head portion of a shisha device according to the invention. The head portion comprises a lid portion 22, which includes a first shell 22A, a second shell 22B and a third shell 22C which all work together to provide a closing of the cavity 10 and some actuation for opening up a top portion of the capsule using further opening elements (top portion of the capsule and further opening elements not shown in this figure). The lid portion closes the cavity 10 which includes a capsule, of which only the bottom portion 12C is shown for the sake of clarity. Downstream of the cavity 10 a plurality of opening elements 14A is shown which together form a crown 14 of opening elements 14A surrounding the perimeter of the bottom portion 12C of the capsule 12. Each opening element 14A cuts a hole in the bottom portion 12C of the capsule 12 which allows an aerosol formed in the capsule to leave the capsule.

Figure 1B:
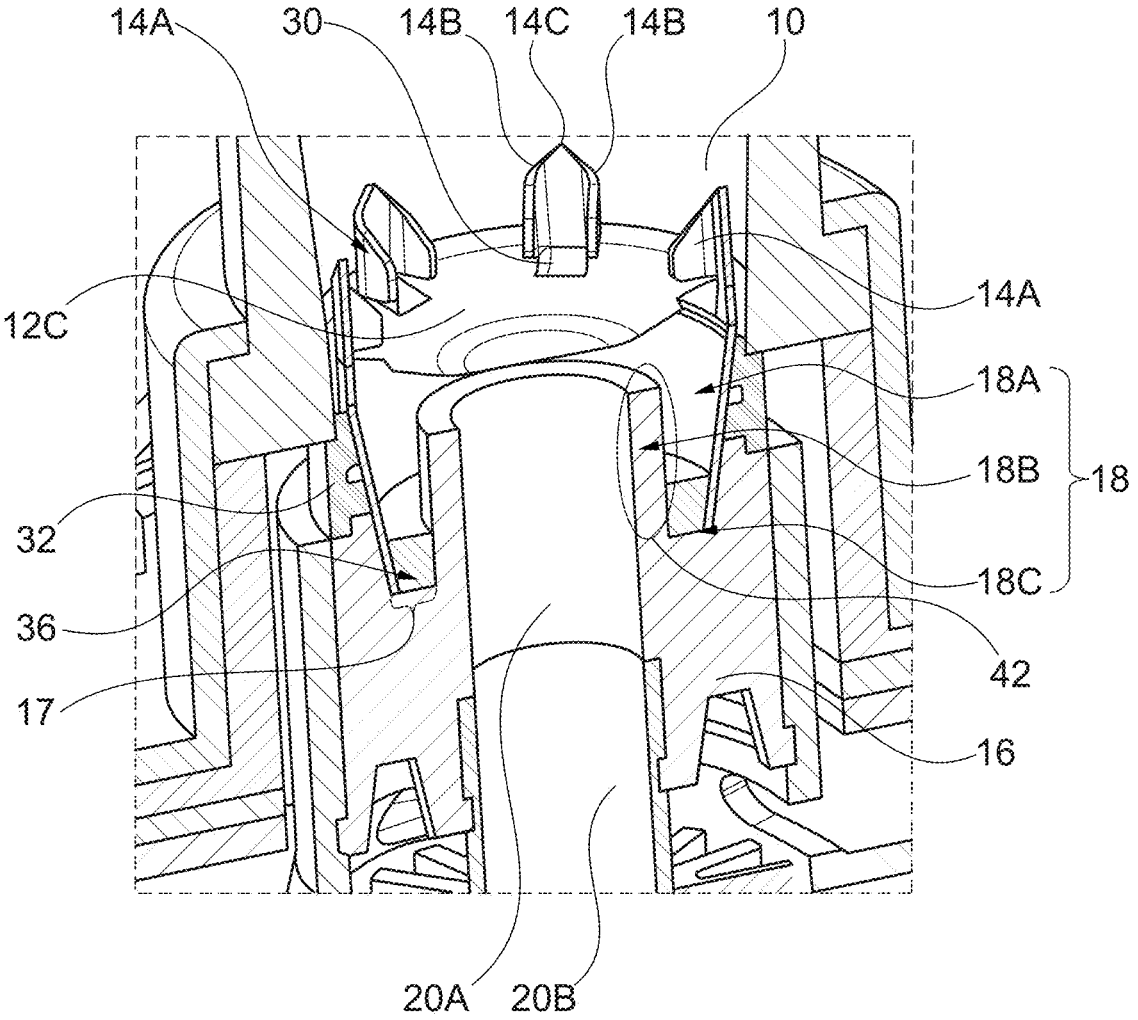
FIG. 1B shows a close up of the perspective view of FIG. 1A.

Downstream of the opening elements 14A, a connection element 16 is located which includes a slot 17 (reference sign 17 only shown in FIG. 1B). In the slot, a conically shaped outer wall 18A for directing one or both of debris and liquid matter from the aerosol-forming substrate included in the capsule 12 into the trough 18. One single annular-shaped trough 18, including the inner wall 18B, the bottom wall 18C and the conically shaped outer wall 18A is present which is able to receive the debris of all the openings produced by the opening elements 14A located upstream. The trough 18 is arranged in such a way that it surrounds the longitudinal central axis 26 of the cavity 10. The connection element 16 also includes a central first airflow channel 20A for the aerosol formed in the capsule.

The head portion of the shisha device may be disassembled into separate elements. A central piece 28 with central tubular portion is present on to which the connection element 16 including the first airflow channel 20A and other parts of the head portion may be mounted. If mounted with the other parts of the head portion of the shisha device, first airflow channel 20A of the connection element 16 may form the upper part of an airflow channel for the aerosol. The airflow channel 20A may then form fittingly abut the stem pipe 20B. The lid portion 22 contains outside air inlets 24. These outside air inlets 24 allow air from the outside of the shisha device to enter the cavity 10 and subsequently be directed into the capsule housed therein via apertures in the top portion of the capsule (apertures not shown in FIG. 1A). The holes cut by the opening elements 14A in the bottom portion 12C of the capsule subsequently allow the aerosol formed in the capsule to exit the capsule and to be directed further downstream through the first airflow channel 20A and the stem pipe 20B.

Heating means 70 for heating the capsule 12 are present which for example may comprise a thermally conductive material having at tubular shape and surrounding the capsule 12 housed in the cavity 10. These heating means 70 may heat the aerosol-forming substrate in the capsule 12 for forming an inhalable aerosol, in particular without burning the contents of the aerosol-forming substrate.

FIG. 1B shows a close up of the perspective view of FIG. 1A. A crown of opening elements 14A is situated on a conically shaped outer wall 18A of the trough. The plurality of opening elements 14A and the conically shaped outer wall 18A are integrally formed. The conically shaped outer wall extends into the annular-shaped slot 17 of the connection element 16. Thus, the trough 18 is formed by the outer wall 18A, the inner wall 18B and the bottom wall 18C. The inner wall and the bottom wall are formed in the connection element 16. In particular, an upstream part 42 of the wall of the first airflow channel 20A also comprises the inner wall of the trough. Additionally, a ring-shaped absorption element 36 is present in the trough 18. Furthermore, a ring-shaped support structure 32 is present abutting the outer perimeter of the outer wall 18A, further stabilizing the crown of opening elements. Each opening element includes two side frames 14B which flank a central section 14C including a tip protruding towards the bottom portion 12C of the capsule 12 when the capsule is housed in the cavity 10. Owing to their design each of the opening elements 14A nearly cut a rectangular hole 30 into the bottom portion of the capsule.

Figure 2:
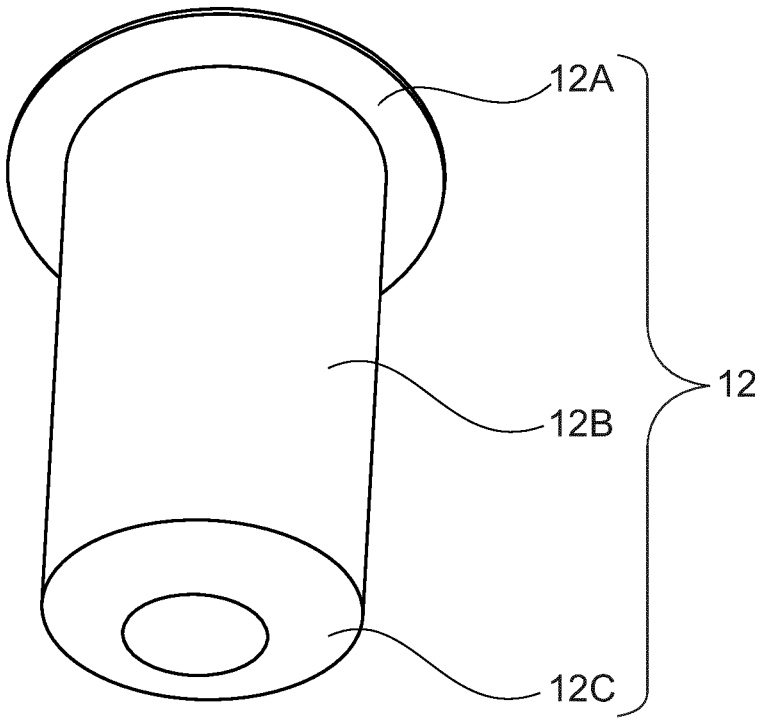
FIG. 2 shows a perspective view of a capsule which may be used in a shisha device of the invention.

FIG. 2 shows a perspective view of a capsule 12 including a top portion 12A, a central portion 12B and a bottom portion 12C. The top portion may include a flat rim for mounting a cover, for example a metal foil for sealing the capsule 12. Such a cover may be able to seal air inlets present in the top portion of the capsule 12. Alternatively, the cover itself may be easily pierced by opening elements located in the lid portion of the shisha device. The central portion 12B may have at tubular shape and holds the aerosol-forming substrate. The bottom portion 12C has a frusto-conical shape and can easily be opened by the opening elements 14A located downstream of the cavity 10 of the shisha device. The overall shape of the capsule may be conical or frustoconical shape.

Figure 3A:
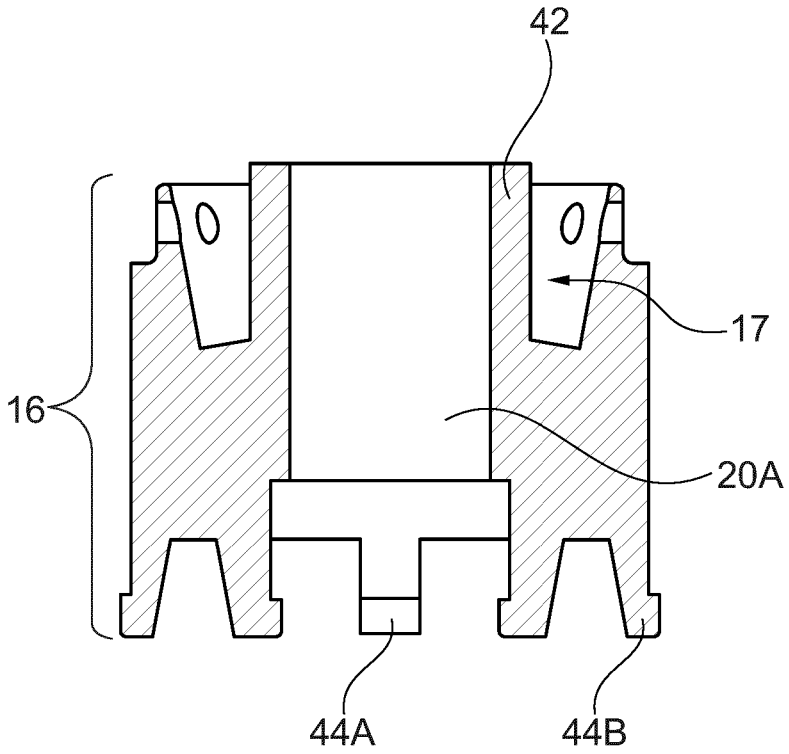
FIG. 3A depicts a cross-sectional view of a connection element of the invention including the first airflow channel and a slot.
Figure 4A:
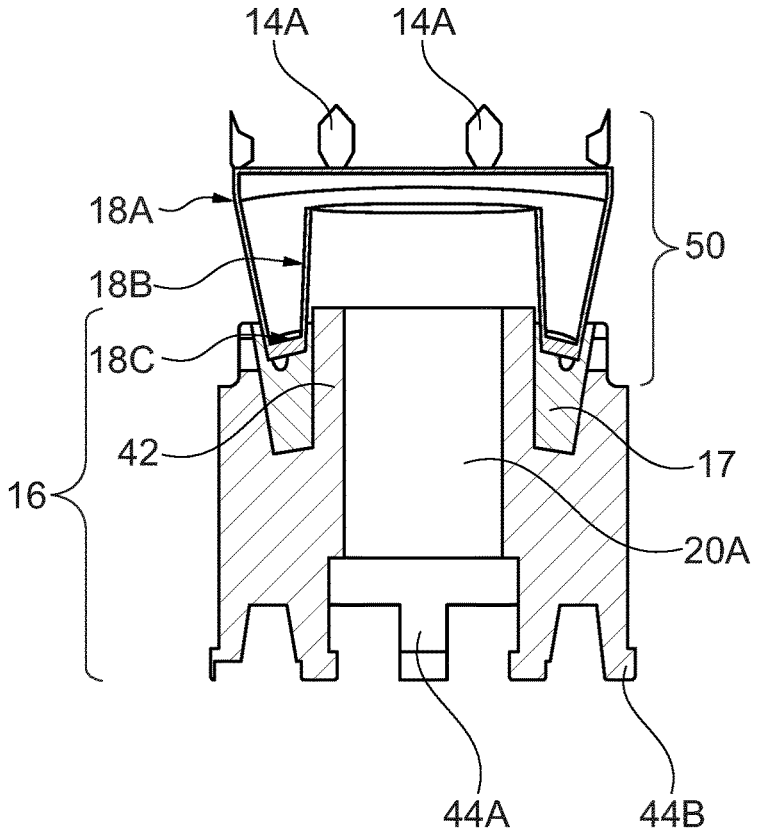
FIG. 4A shows a cross-sectional view of an assembly of a connection element together with the trough and the opening element.

FIG. 3A shows a cross-sectional view of the connection element 16. This connection element may be formed as one piece for example by extrusion of polymers and includes a slot 17. An outer wall of the trough (not shown in this FIG. 3A) might be positioned in this slot 17. Alternatively, the trough including the outer wall, inner wall and bottom wall integrally formed with the opening element might be included in the slot, as shown in FIG. 4A. The central part of the connection element 16 includes an upstream part 42 of a wall of the first airflow channel 20A. Additionally, inner snap noses 44A and outer snap noses 44B are located in the bottom part of the connection element 16. The snap noses may be used in order to connect the connection element with the stem pipe. In particular, the outer snap noses 44B may be used in order to connect the connection element 16 to a tubular core section of the stem pipe. The inner snap noses 44A may be used in order to provide a formfitting connection between the first air flow channel of the connection element 16 and the second airflow channel of the stem pipe of the shisha device.

Figure 3B:
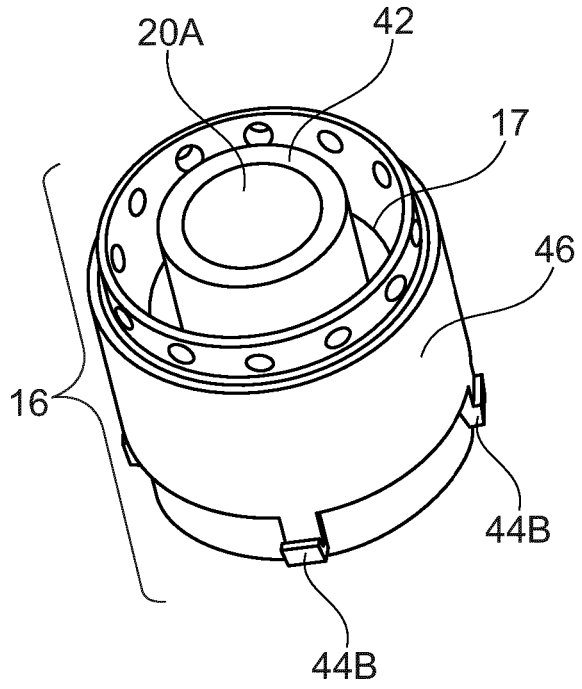
FIGS. 3B and 3C show perspective views of the connection element of FIG. 3A viewed from the top and from the bottom, respectively.

FIG. 3B shows a perspective view of the connection element 16 presented in cross-sectional view in FIG. 3A. The connection element 16 has an overall tubular shape with a central tubular airflow portion 20A with an inner wall 42 and an outer tubular wall 46. The annular-shaped slot 17 extending around the central first airflow channel 20A with its outer wall 46 can clearly be seen.

Figure 3C:
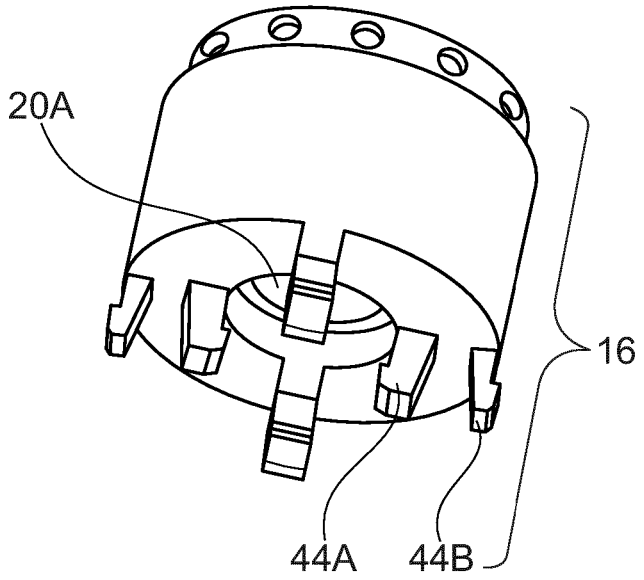

FIG. 3C shows a perspective view from the bottom of the connection element 16 of FIG. 3B. This perspective view clearly shows the outer snap noses 44B for connection with the tubular section of the stem pipe and the inner snap noses 44A providing a connection to the stem pipe of the shisha device.

FIG. 4A shows an alternative arrangement of a crown 14 of opening elements 14A which together with the outer wall 18A, the inner wall 18B and the bottom wall 18C of the trough is formed integrally into one single piece 50.

This single piece 50 is mounted into the slot 17 of the connection element 16 in order to provide a positioning of the opening elements 14A and the trough relative to the connection element 16 and its first airflow channel 20A. Any debris released by openings created by the opening elements 14A will slide down the outer wall 18A of the trough and will be collected at the bottom wall 18C of the trough in the piece 50. The opening elements 14A are the elements which are most upstream, whereas the bottom part of this arrangement is the most downstream part of the arrangement.

Figure 4B:
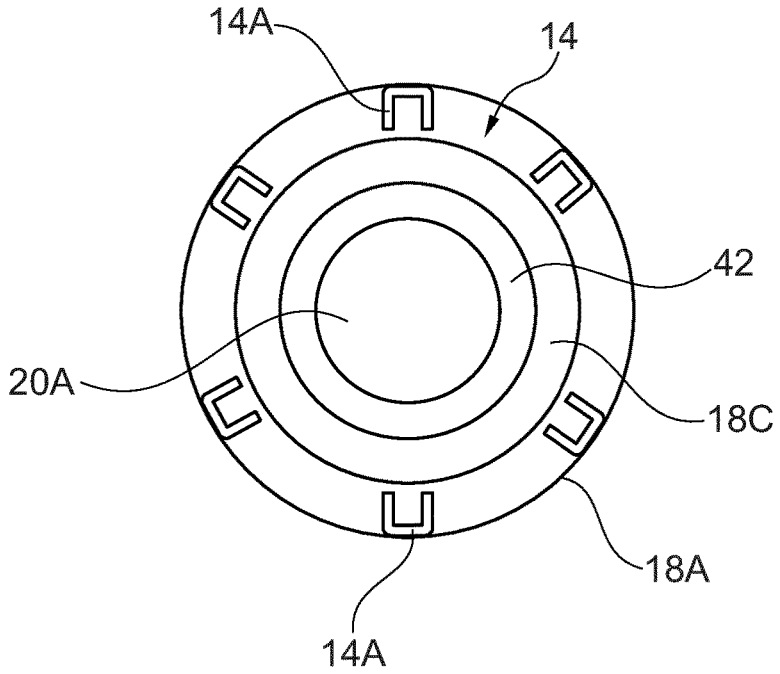
FIG. 4B shows a view of the assembly of FIG. 4A from the top.

FIG. 4B shows a top view of the arrangement shown in FIG. 4A. A plurality of six opening elements 14A, each opening element comprising two side frames flanking a section including a sharp tip protruding from the opening elements can be seen. The opening elements 14A are arranged in a ring-like manner on the crown 14. Debris originating from the holes in the capsule 12 produced by the opening elements 14A may be received at the bottom wall 18C of the trough. Furthermore, the wall 42 of the connection element is visible.

Figure 5:
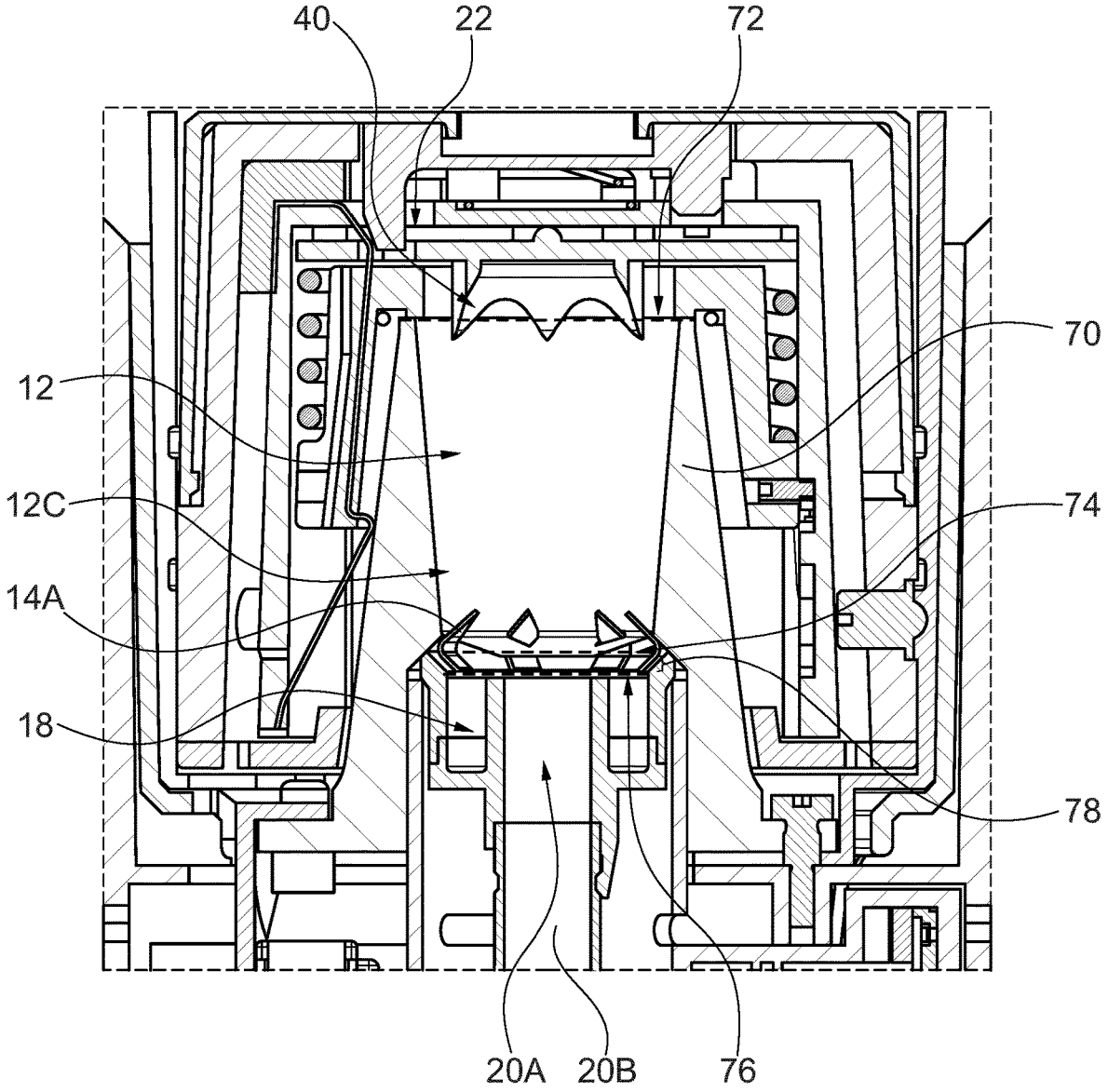
FIG. 5 shows a cross-sectional view of head portion of shisha device including the cavity, the trough and the connection element.

FIG. 5 shows a cross-sectional view of a head portion of one embodiment of a shisha device in accordance with the invention. Heating means 70 are present, which define a cavity into which a capsule 12 is housed. The lid portion 22 of the shisha device includes further opening elements 40 piercing into the top portion of the capsule 12. The further opening elements 40 extend through the upstream end face 72 of the cavity and provide openings for the air to enter the capsule. The downstream end face 74 of the cavity aligns with the bottom portion 12C of the capsule 12. Opening elements 14A are present. The opening elements 14A provide openings in the bottom portion 12C of the capsule which allow the aerosol formed in the capsule to exit the capsule. Downstream of the opening elements and downstream of the downstream end face 74 of the cavity, the trough 18 is provided which may receive one or both of the debris and liquid components of the aerosol-forming substrate of the capsule, which may be released from the capsule via the openings provided by the opening elements. The opening elements 14A extend into the cavity through the downstream end face 74. Such a spatial arrangement ensures reliable opening of the bottom portion 12C of the capsule by the opening elements when the capsule is received in the cavity. A gap 78 is present between the downstream end face 74 of the cavity and upstream end face 76 of the first airflow channel 20A. This gap 78 enables the aerosol being released through the holes produced by the opening elements to enter the first airflow channel 20A and subsequently be channelled further through the shisha device. The trough 18 surrounds the first airflow channel, in particular it surrounds a perimeter of the upstream end face 76 of the first airflow channel and therefore is configured to receive any debris from the openings in the capsule produced by the opening elements without contaminating the first airflow channel with debris.

Figure 6:
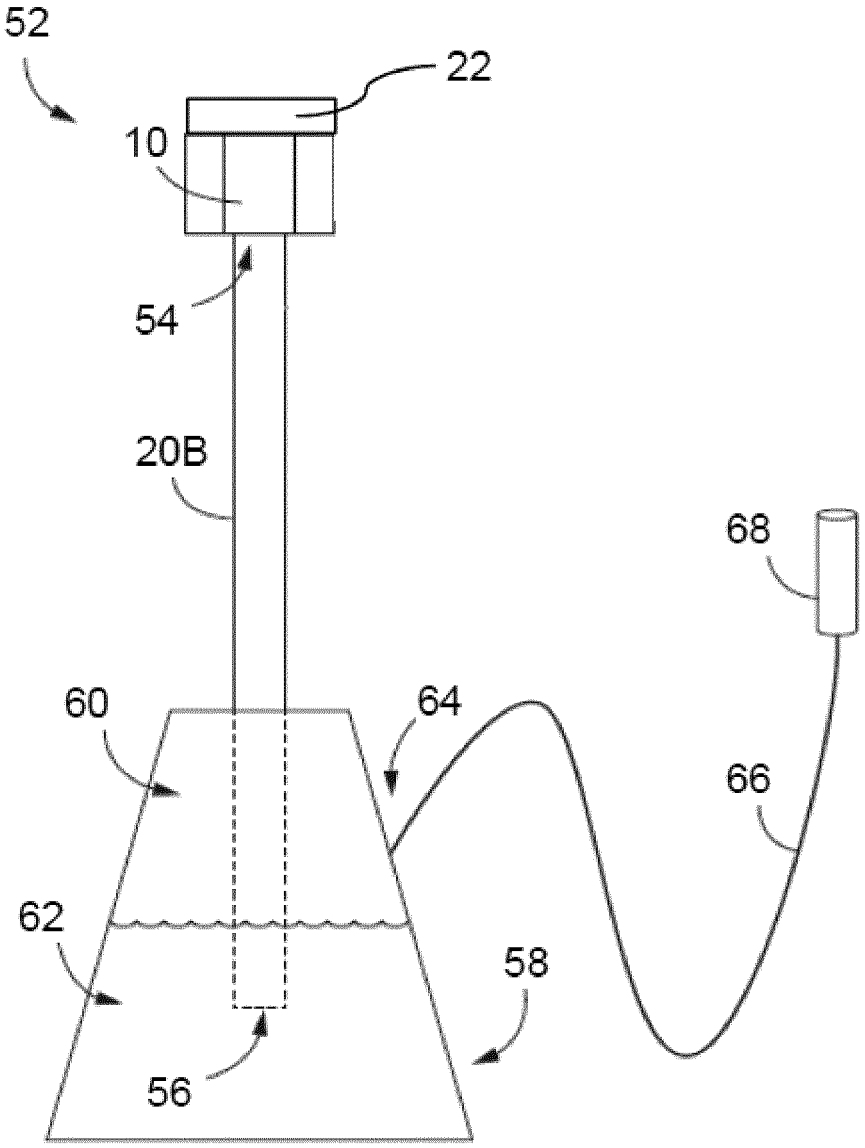
FIG. 6 depicts a schematic view of a shisha device of the invention.

FIG. 6 shows the complete shisha device 52 of the invention. The head portion 54 of the shisha device is the most upstream element of the shisha device and includes the lid section 22 and the cavity 10. In order to provide more clarity, the details of the cavity 10 including the opening elements 14A and trough 18 are not shown in FIG. 6. The stem pipe 20B is located downstream of the head portion 54 and is able to direct an aerosol formed in the capsule 12 housed in the cavity 10 into a liquid vessel 58. This liquid vessel 58 contains a portion 62 filled with a liquid, in particular water which might include additional flavouring agents and a gas headspace 60 containing a gas residing above the liquid in the vessel. The aerosol formed will be released into the liquid portion 62 of the liquid vessel 58 at the most downstream end 56 of the stem pipe 20B. The aerosol may pass through the liquid portion 62 of the liquid vessel and rise into the head space volume 60. Puffing by a user on a mouthpiece 68 of the hose 66 may draw the aerosol in the headspace 60 through the head space outlet 64 and into the hose 66 for inhalation. In particular, negative pressure at the mouthpiece 68 may translate into negative pressure at the head space outlet 64 causing airflow through the pierced capsule housed in the cavity 10 of the shisha device.

The invention claimed is:

1. An aerosol-generating system comprising:
- a pierceable capsule comprising an aerosol-forming substrate, and
- a shisha device comprising:
  - a cavity configured for receiving the pierceable capsule, the aerosol-forming substrate comprising a liquid; and
  - a trough in fluid communication with the cavity, and
  - at least one opening element being formed as a piercing element, the at least one opening element being located upstream of the trough,
  - wherein the trough comprises an absorption element, the absorption element being configured for absorbing liquid originating from the pierceable capsule when the capsule is pierced by the piercing element of the at least one opening element.

2. The aerosol-generating system according to claim 1, wherein the trough is arranged downstream of the cavity.

3. The aerosol-generating system according to claim 1, wherein the trough comprises an annular shape.

4. The aerosol-generating system according to claim 1, wherein the trough is centred about a longitudinal central axis of the cavity.

5. The aerosol-generating system according to claim 1, further comprising a first airflow channel in fluid communication with the cavity, wherein the first airflow channel is configured as a central tubular first airflow channel.

6. The aerosol-generating system according to claim 5, wherein the trough is arranged around the first airflow channel.

7. The aerosol-generating according to claim 6, wherein the shisha device further comprises a second airflow channel of a stem pipe in fluid communication with the first airflow channel.

8. The aerosol-generating system according to claim 5, further comprising a connection element, wherein the connection element comprises or at least partially defines the first airflow channel.

9. The aerosol-generating system according to claim 8, wherein the trough comprises an inner wall, and a bottom wall, wherein the connection element further comprises one or both of said inner wall and bottom wall of the trough.

10. The aerosol-generating system according to claim 9, wherein the inner wall of the trough forms a portion of the first airflow channel.

11. The aerosol-generating system according to claim 8, wherein the connection element is configured removably attached to the shisha device.

12. The aerosol-generating system according to claim 5, wherein the first airflow channel is arranged along a longitudinal central axis of the cavity.

13. The aerosol-generating system according to claim 1, wherein the trough has a conically shaped outer wall.

14. The aerosol-generating system according to claim 1, wherein the trough comprises an inner wall, an outer wall, and a bottom wall, wherein said inner wall, outer wall, and bottom wall are integrally formed.

15. The aerosol-generating system according to claim 1, wherein the absorption element comprises a retention material or a high liquid retention material.

16. The aerosol-generating system according to claim 15, wherein the retention material or high liquid retention material is a fibrous retention material.

17. The aerosol-generating system according to claim 1, wherein the opening element and the trough are integrally formed.

18. The aerosol-generating system according to claim 1, wherein the absorption element is at or proximal to a bottom wall of the trough.

19. Aerosol-generating system according to claim 1, wherein the liquid comprises a liquid aerosol-former.

* * * * *